United States Patent [19]

Takenaka et al.

[11] 4,071,362

[45] Jan. 31, 1978

[54] ELECTROPHOTOGRAPHIC COPYING FILM

[75] Inventors: Haruo Takenaka; Toshiaki Okiyama; Toshio Kawamata, all of Tokyo, Japan

[73] Assignee: Fuji Photo Film Co., Ltd., Japan

[21] Appl. No.: 321,474

[22] Filed: Jan. 5, 1973

[51] Int. Cl.[2] ..... G03G 5/02

[52] U.S. Cl. ..... 96/1.4; 427/25

[58] Field of Search ..... 117/161 UC, 161 ZA, 117/161 UZ; 96/1.5, 1.4, 114.2; 427/340, 385, 25

[56] References Cited

U.S. PATENT DOCUMENTS

| | | | |
|---|---|---|---|
| 2,805,963 | 9/1957 | Gaylord | 117/161 |
| 2,952,655 | 9/1960 | Beck | 117/161 UC |
| 2,976,250 | 3/1961 | Walford | 96/114.2 |
| 2,989,420 | 6/1961 | Zdanowski | 117/161 UC |
| 3,033,679 | 5/1962 | Laakso et al. | 96/114.2 |
| 3,573,040 | 3/1971 | Back | 117/161 UC |
| 3,640,838 | 2/1972 | Chow et al. | 117/161 UC |
| 3,681,070 | 8/1972 | Timmerman | 96/1.5 |

*Primary Examiner*—David Klein
*Assistant Examiner*—John L. Goodrow
*Attorney, Agent, or Firm*—Gerald J. Ferguson, Jr.; Joseph J. Baker

[57] ABSTRACT

An electrophotographic coating film having an improved receptivity for electrophotographic toners and a reduced tendency to blocking comprises a thermally resistant base film and a coating layer containing 0.1 to 10% by weight of one or more matting agents and formed of resins which contain a styrene-acrylate or -methacrylate ester copolymer containing at least 10% by weight of copolymerized styrene.

15 Claims, 2 Drawing Figures

ELECTROPHOTOGRAPHIC COPYING FILM

BACKGROUND OF THE INVENTION

1. Field of the Invention

This invention relates to an electrophotographic coating film and, more particularly, to an electrophotographic coating film having, on a plastic film resisting temperature of 100° C or more, a coating layer containing a styrene-acrylate or -methacrylate ester copolymer of a styrene content of at least 10% by weight.

2. Description of the Prior Art

There have generally been used as electrophotographic coating films for dry processes such as, e.g., the Xerox system, uncoated polyester films and polyester films coated with an organic solvent-soluble ester resin. These conventional electrophotographic coating films, however, have some drawbacks in that they give a coating image thereon of low optical density due to low thermal fixing, or compatibility to an electrophotographic toner and when a pile of numeral leaves of such a film is placed in a copying machine for making a numbers of copy two or more leaves are occasionally withdrawn at a time from the feeding tray.

SUMMARY OF THE INVENTION

The object of the present invention is to provide an improved electrophotographic coating film which has high thermal fixing or compatibility for electrophotographic toner, provides a coating image of a high optical density and can be withdrawn from a feeding tray without double feeding.

We have discovered that the above object is achieved by applying a styrene-acrylic or -methacrylic ester copolymer of resins which contain a styrene content of at least 10% by weight, together with a matting agent, to a plastic film resisting temperatures of 100° C or more (determined according to ASTM test number D759-66 by measuring the resistance of plastic films against heat (softening point). In this connection, reference can be made to *Modern Plastics Encyclopedia,* 1971-1972, pp. 662-625 published by McGraw-Hill, Inc.).

It is difficult to satisfactorily achieve the above object by use of an ester resin, acrylic ester resin or methacrylic ester resin alone.

The aforesaid resinous layer containing a matting agent may be applied to a single surface or to the both surfaces of the plastic film. In case of a plastic film a single surface of which has been coated with a matted resinous layer, it is preferred to apply an antistatic coating layer on the other surface thereof.

DETAILED DESCRIPTION OF THE INVENTION

Figure 1:
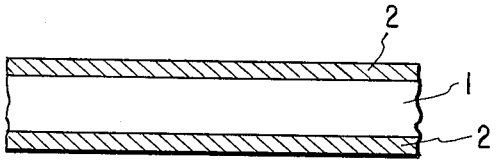
FIG. 1 and FIG. 2 show cross-sections of electrophotographic films in accordance with the present invention.
Figure 2:
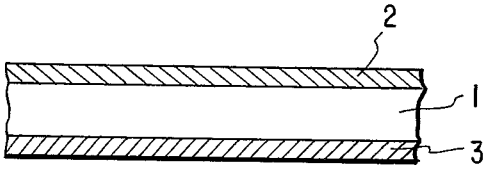

In FIGS. 1 and 2, numeral I indicates a plastic film of a thermal resistance of 100° C or more, numeral 2 indicates a coating resin layer containing a styrene-acrylate or -methacrylate ester copolymer of a styrene content of at least 10% by weight in accordance with the present invention in which there has been incorporated a matting agent, and numeral 3 indicates an antistatic coating layer.

The acrylic and methacrylic esters in the copolymers of styrene with an acrylic ester or a methacrylic ester to be used in the practice of the present invention are exemplified by, e.g., methyl acrylate, ethyl acrylate, butyl acrylate, methyl methacrylate, n-butyl methacrylate and i-butyl methacrylate. Preferred are the alkyl acrylates or alkyl methacrylates having from 1 to 5 carbon atoms in the alkyl group. In the copolymer styrene preferably is used in an amount of at least 10% by weight up to 90% by weight, more preferably 20% to 80% by weight more desirably in an amount of 20% by weight or more and, correspondingly, an acrylic or methacrylic ester is used in an amount of at most 90% by weight, more desirably in an amount of 80% by weight or less. These copolymers will generally be used at a molecular weight of from about 10,000 to about 200,000, more preferably from 50,000 to 150,000. While somewhat higher and lower molecular weights can be used, results generally are not as good as with operation within the broad range recited. As resins which can be present with the copolymer used in the practice of the present invention there can be examplified nitrocellulose, cellulose acetate and other cellulose esters, an organic solvent soluble ester resin, e.g., polymeric terephthalic acid mixed esters as disclosed in U.S. Pat. No. 3,100,722. polycarbonate, polysulfones, polyvinylidene chloride and polyphenylene oxide having a molecular weight of from 100,000 to 250,000. These additive resins serve as increasing thermal resistance of the copolymers used in the present invention. The expression "polymeric terephthalic acid mixed esters" is meant to designate co-polyesters which are obtained by esterification and polycondensation of mixtures of acids containing terephthalic acid and at least one further dicarboxylic acid, e.g. isophthalic acid, ortho-phthalic acid, adipic acid, or sebacic acid, with bivalent alcohols containing up to 10 carbon atoms in the molecule. Alcohols of this kind are e.g.: ethyleneglycol, trimethyleneglycol, tetramethyleneglycol, pentamethyleneglycol, hexamethyleneglycol, heptamethyleneglycol decamethyleneglycol, and propyleneglycol. The polymeric terephthalic acid mixed esters to be used in accordance with the invention are well known. Excellent results are obtained when using mixed esters obtained from mixtures of acids containing per 100 mols of terephthalic acid 10 to 50 mols of said other dicarboxylic acid. The copolymer is preferably used in an amount of from 5% to 100% by weight of the total weight of the resins present in the coating layer, i.e., the additive resin is optionally used in an amount of from 0 to 95% by weight.

A solvent is generally used for ease of coating to dissolve the coating resins which contain the copolymer, e.g., methanol, ethanol and like alcohols; acetone, methyl ethyl ketone and like ketones; methylene chloride, ethylene chloride, tetrachloroethane and like chlorinated hydrocarbons; and mixtures thereof. The solvent is removed during final film formation.

On the application of such a solution to a polyester film as a base film, there may be incorporated in the solution a swelling agent for the polyester film to enhance the adhesion between the copolymer layer and the polyester film. The swelling agent for the polyester film is suitably used in the amount of 2 to 10% by weight based on the total weight of the solvents. The swelling agent for the polyester film suitably used includes, e.g., phenol, resorcinol, o-chlorophenol, p-chlorophenol, cresol and like phenol derivatives, benzoic acid, salicyclic acid, salicylic esters, monochloroacetic acid, trichloroacetic acid, trifluoroacetic acid, 2-nitropropanol, benzyl alcohol, benzaldehyde, acetonylacetone, acetophenone, benzamide, benzonitrile and methyl nicotinate.

Various methods which can be used for the synthesis of the styrene-acrylate and styrene-methacrylate copolymers are described in E. H. Ryddle, *Monomeric Acrylic Esters,* page 93, 1954 published by Reinhold Publishing Co.

Separately, a matting solution is prepared by dissolving a copolymer in accordance with the present invention and optionally other additive resins in a solvent to form a solution having from 10% to 50% by weight of the copolymer and other resin, adding to the resulting solution a matting agent having an average particle size of from 0.1 micron to 10 microns, preferably from 1 micron to 5 microns to prepare a solution containing from 10% to 50% by weight of a total amount of the copolymer and the resin, if used, and from 0.5% to 15% by weight of the matting agent, such as, e.g., fine particles of silicon dioxide, starch or alumina, or a plastic powder, e.g., polyethylene, polyester or polyacrylonitrile, and agitating the resulting mixture in an efficient agitator to uniformly disperse the matting agent in the solution. The matting agents preferably have a size of from 0.1 || to 10 ||, more preferably from 1 || to 5μ.

The final coating solution is then prepared by adding the matting solution to the solution of a copolymer in accordance with the present invention, optionally adding thereto a coloring agent and/or other optional additives, thoroughly agitating the resulting system and thereafter filtering the mixture to remove any impurities or undissolved substances which may be present in the mixture so that the general surface properties will be as good as and any tendency to coating unevenness will be avoided. As the coloring agents there may be used organic pigments such as anthraquinone dyes and derivatives such as 1-(p-methylphenylamino)-4-hydroxyanthraquinone, 1,4-diphenylaminoanthraquinone, 1-anilino-4-hydroxyanthraquinone, 1,4-di-(m-methylphenylamino)anthraquinone and like dyes; azo dyes and derivatives thereof; triphenylmethane dyes and derivatives thereof; quinoline dyes and derivatives thereof; inorganic pigments such as carbon black, titanium white, white lead, red iron oxide and the like.

The matting agent is preferably added in an amount of 0.1 to 10% by weight of the copolymer. An amount of less than 0.1% by weight is insufficient to prevent double feeding from a feeding tray and use of matting agent in an amount exceeding 10% by weight results in a copied image of inferior quality.

The coating solution thus obtained is applied to a plastic film of a thermal resistance withstanding temperatures of 100° C or more, such as polyethylene terephthalate, polysulfone, polyphenylene oxide, polyamide, polycarbonate, cellulose ester or polyamide, in an amount so as to provide a dried coating film of a thickness of 0.3 to 5 microns.

When only one side of the thermally resistant plastic film is coated with the copolymer/matting agent the opposite side is preferably coated with an antistatic coating layer which is generally of a dried thickness of less than 1.0 micron, preferably from 0.1 micron to 0.5 micron. Then the antistatic coating solution usually contains is from 0.01% to 2.0% by weight antistatic agent. The solvent for the antistatic coating solution is usually the same solvent which is used to dissolve the copolymer in accordance with the present invention and the other additive resin. Further from 0.5% to 5.0% by weight of the additive resin may be dissolved as a binder in the antistatic coating solution having from 0.01% to 2.0% by weight of anti-static agent. In this case, the coating layer usually has a 0.5 micron to 3.0 micron dried thickness. An antistatic coating solution containing a binder provides the same effect as an antistatic coating solution without binder but the antistatic provides effect is more durable, i.e., antistatic layer contains 2.0% to 40.0% by weight of the antistatic agent based on the total weight of the binder resins.

The antistatic agents which may be used in the present invention are naphthalene-sulfonates, ethylene oxide addition products, phosphoric esters, anionic surface active agents, such as alkyl metal sulfates, alkyl aryl metal sulfates, alkyl naphthaline metal sulfates and alkyl metal sulfonates, each having 10 to 20 carbon atoms in the alkyl moiety and the metal being Na, K, Mg or Ca, cationic surface active agents such as alkyl amine salts having 10 to 20 carbon atoms in the alkyl moiety with a metal such as Na, K, Mg or Ca, alkyl dimethyl ammonium chlorides having 10~20 carbon atoms in the alkyl moiety, and dialkyl dimethyl ammonium chlorides having 10~20 carbon atoms in the alkyl moiety, and nonionic surface active agents such as polyoxyethylene alkyl phenols, having 10~20 carbon atoms in the alkyl moiety, and polyoxyethylene polyalcohols, the alcohol being aliphatic alcohols having 10~20 carbon atoms.

Plastic films of a thermal resistance not resisting a temperature of 100° C or more are of no use in the present invention because they are wrinkled or otherwise deformed when they are used in a Xerox of like dry electronic copying machine. The thickness of the plastic film is preferably on the order of 50 to 200 microns. The electrophotographic film thus obtained fuses together well with an electrophotographic toner to give a copied image of a high optical density when subjected to copying in a dry electronic copying machine and can be successively withdrawn from a feeding tray without double feeding. The electrophotographic printing film thus obtained is of great value in e.g., overhead projection and two side copying.

The present invention will now be illustrated in more detail by the following examples in which all parts and percentages are by weight.

EXAMPLE 1

In 100 parts of a 16:2:1:1 mixture of ethylene chloride: methylene chloride:phenol:tetrachloroethane there was dissolved 4 parts of a copolymer of 65% of styrene with 35% of butyl acrylate (average molecular weight:150,000). In 150 parts of the above solvent there was dissolved 44 parts of the same copolymer, and there was added thereto 6 parts of finely divided polyacrylonitrile as a matting agent with stirring. 2.0 parts of this matting solution was then dissolved the above coating solution, with stirring. The solution was then applied to both sides of a 100 micron thick polyester film in an amount so as to provide on each side a dry coating film of a thickness of 1.3 microns to, thereby obtain a coating film. The electrophotographic film thus obtained was superior to a polyester film coated with an ester resin (Conventional product 1) and an uncoated polyester film (Conventional product 2) in the points indicated in Table 1.

Table 1

| Electronic copying machine used: Xerox 720, Fuji-Xerox Co. | Conventional product 1 | Conventional product 2 | Product of Ex. 1 |
|---|---|---|---|
| Density of image | B | B | A |
| Thermal fixing of toner | B | D | A |
| Double feeding | No | Yes | No |
| Utility | Single surface only usable | Single surface only usable | Both surfaces usable |

*Double feeding: This term means that when a pile of printing film sheets was set in a feeding tray of an electronic copying machine, two or more leaves of the film were simultaneously withdrawn or fed from the feeding tray.
Evaluation: A Excellent, B Good, C Passable, D Poor

EXAMPLE 2

Onto a single surface of 100 micron thick poly(phenylene oxide) film there was applied the same solution as in Example 1 to form a coating film of a dry thickness of 1.5 microns, and on the other surface there was applied a solution of 1 part of an antistatic agent, alkylbenzimidazolesulfonate, in 500 parts of a 1:1 mixture of methanol:acetone to form a coating layer of a dry thickness of 0.8 micron. The coating film thus obtained was superior to uncoated polyphenylene oxide film in the points indicated in Table 2.

Table 2

| Electronic copying machine used: Xerox 720, Fuji-Xerox Co. | Uncoated film | Coated film |
|---|---|---|
| Density of image | B | A |
| Thermal fixing of toner | D | A |
| Double feeding | Yes | No |
| Utility | Both sides usable | Single surface only usable |

EXAMPLE 3

A solution of 4 parts of a copolymer of 20% of styrene and 80% of methyl methacrylate (average molecular weight:120,000) prepared in as in Example 1 was applied to a 100 micron thick polycarbonate film to form a coating layer of a dry thickness of 2.0 microns on each side of the polycarbonate film (both sides coated coating film). On the other hand, the coating solution was applied to a single surface of another 100 micron thick polycarbonate film as in Example 2, and then there was applied to the other surface a solution of 1 part of an antistatic agent, alkylbenzimidazolesulfonate, in 500 parts of an 1:1 mixture of methanol and acetone to form an antistatic coating of a dry thickness of 0.5 microns (single side coated coating film).

Both films thus obtained in accordance with the present invention were superior to uncoated polycarbonate film in the points indicated in Table 3.

Table 3

| Electronic copying machine used: Xerox 720, Fuji-Xerox Co. | Uncoated film | Both sides-coated | Single side-coated |
|---|---|---|---|
| Density of image | B | A' | A |
| Thermal fixing of toner | C | A | A |
| Double feeding | Yes | No | No |
| Utility | Both sides usable | Both sides usable | Single side only |

The evaluation standards were the same as in Example 1 except that A was divided into two grades, A and A', and evaluation was made in 5 degrees, A, A', B, C and D.

EXAMPLE 4

A solution of 4 parts of a copolymer of 80% styrene and 20 % i-butyl methacrylate (average molecular weight:90,000) prepared as in Example 1 was applied to both surfaces of a 80 micron thick polysulfone film to form coating layers of a thickness of 2.5 microns in the dry state (both sides coated film). Separately, to only a single surface of another 80 micron thick polysulfone film was coated as in Example 2, and the other surface of the film had applied thereto a solution of 1 part of an antistatic agent, alkylbenzimidazolesulfonate, in 500 parts of an 1:1 mixture of methanol and acetone to form a dry anti-static coating layer of a thickness of 1.0 micron (single side coated film).

Compared to an uncoated polysulfone film, the coated films thus obtained were superior in the points indicated in Table 4.

Table 4

| Electronic copying machine used: Xerox 720, Fuji-Xerox Co. | Uncoated film | Both side coated | Single side coated |
|---|---|---|---|
| Density of image | B | A' | A' |
| Thermal fixing of toner | B | A | A |
| Double feeding | Yes | No | No |
| Utility | Both sides usable | Both sides usable | Single side only |

EXAMPLE 5

In 100 parts of a 9:1 mixture of methylene chloride and tetrachloroethane there was dissolved 1.5 parts of a copolymer of 65% styrene with 35% of butylacrylate (average molecular weight:80,000) and 3.5 parts of an ester resin (ester-resin 20 by Toyobo Co., Ltd.). In 120 parts of the above solvent there was dissolved 35 parts of a mixture of the above copolymer (30% by weight) and ester resin (50% by weight), and then added thereto 0.06 parts of finely divided silicon dioxide as a matting agent, with stirring. 2.0 parts of this matting solution was dissolved in the above coating solution, with stirring.

The solution was then applied to both sides of an 80 micron thick polyethylene terephthalate film to form a coating layer of a dry-thickness of 2.0 microns. The copying film thus obtained was superior to uncoated polyethylene terephthalate film in the points as indicated in Table 5.

Table 5

| Electronic copying machine used: Xerox 720, Fuji Xerox Co., Ltd. | Uncoated film | Both sides-coated film |
|---|---|---|
| Density of image | B | A |
| Thermal fixing of toner | D | A |
| Double feeding | Yes | No |
| Utility | Both sides usable | Both sides usable |

EXAMPLE 6

A solution of 5.0 parts of nitrocellulose (RS 1/16, Daisel Ltd.; 1/16 second measured by JIS K-6703 "ball drop method" at solution of nitrocellulose 12.2%, ethanol 22.0%, ethylacetate 17.5% and toluene 48.3% by weight; this method measure polymer solution droping speed into a glass tube having a 25 mm diameter and a 2.54 mm length, and the tube includes an iron ball having 7–9 mm diameter and a 7g weight.) and 0.5 parts of a copolymer of 20% of styrene and 80% of methylmethacrylate (average molecular weight:50,000), and 3.0 parts of a matting solution as described in Example 5 were prepared in a similar manner as in Example 5 and applied to a 120 micron thick polycarbonate atom to form a coating layer of a dry thickness of 2.5 microns on each side of the polycarbonate film (a both sides coated copying film). The copying film thus obtained was superior to an uncoated polycarbonate film in the points indicated in Table 6.

Table 6

| Electronic copying machine used: Xerox 720, Fuji Xerox Co., Ltd. | | |
|---|---|---|
| | Uncoated film | Both sides-coated film |
| Density of image | B | A |
| Thermal fixing of toner | D | A |
| Double feeding | Yes | No |
| Utility | Both sides usable | Both sides usable |

While the invention has been described in detail and with reference to specific embodiments thereof, it will be apparent to one skilled in the art that various changes and modifications can be made therein without departing from the spirit and scope thereof.

What is claimed is:

1. An electrophotographic process comprising the steps of forming a toner image on a recording layer;

transferring said toner image to a copy film comprising a plastic film support having a thermal resistance withstanding temperatures of 100° C or more having coated on the surface thereof a coating layer formed of resins with contain a copolymer of at least 10% by weight of styrene with correspondingly at most 90% by weight of a comonomer selected from the group consisting of acrylic and methacrylic esters, said coating layer containing 0.1 to 10% by weight, based on the weight of copolymer, of one or more matting agents, said toner image being transferred to said coating layer of said film thereby enhancing the bonding compatibility for the toner, increasing the optical density of the transferred toner image, and decreasing the tendency for the films to be double fed.

2. An electrophotographic process as claimed in claim 1 wherein the molecular weight of the copolymer is about from 10,000 to 200,000.

3. An electrophotographic process as claimed in claim 1 wherein said acrylic and methacrylic ester are alkyl acrylates or alkyl methacrylates having from 1 to 5 carbon atoms in the alkyl group.

4. An electrophotographic process as claimed in claim 1 wherein said resin coating layer contains said copolymer and at least one additional additive resin different from said copolymer.

5. An electrophotographic process as claimed in claim 4 wherein said at least one additive resin is a cellulose ester, an organic solvent soluble ester resin, a polycarbonate, a polysulfone, a polyvinylidene chloride or a polyphenylene oxide.

6. An electrophotographic process as claimed in claim 4 wherein the amount of said at least one additive resin is at least 5% by weight of total weight of the resins present in the coating layer.

7. An electrophotographic process as claimed in claim 1 wherein said matting agent has a 0.1 micron to 10 micron average particle size.

8. An electrophotographic process as claimed in claim 7 wherein said matting agent is selected from the group consisting of silicon dioxide, starch, alumina and a plastic powder.

9. An electrophotographic process as claimed in claim 1 wherein said plastic film is selected from the group consisting of polyethylene terephthalate, a polysulfone, a polyphenylene oxide, a polyamide, a polycarbonate, a cellulose ester and a polyamide.

10. An electrophotographic process as in claim 1 wherein one side of said film support is coated with said coating layer and the opposite side is coated with an antistatic layer.

11. An electrophotographic process as claimed in claim 10 wherein said antistatic layer contains an antistatic agent, and in the dried thickness of 0.1 micron to 0.5 micron.

12. An electrophotographic process as claimed in claim 11 wherein said antistatic agent is selected from the group consisting of naphthalene sulfonates, ethylene oxide addition products and phosphoric esters.

13. An electrophotographic process as claimed in claim 10 wherein said antistatic layer contains a binder resin.

14. An electrophotographic process as claimed in claim 13 wherein said antistatic layer contains 2.0% to 40.0% by weight of antistatic agent of total weight of binder resins, and in the dried thickness of 0.5 micron to 3.0 micron.

15. An electrophotographic process as claimed in claim 14 wherein said binder resin is selected from the group consisting of cellulose esters, organic solvent soluble ester resins, polycarbonates, polysulfones, polyvinylidene chloride and polyphenylene oxides.

* * * * *